United States Patent [19]

Roy et al.

[11] Patent Number: 4,798,545

[45] Date of Patent: Jan. 17, 1989

[54] ELECTRICAL TERMINAL RECEPTACLE AND ELECTRICAL COMPONENT HOUSING ADAPTED FOR THE SAME

[75] Inventors: Dhirendra C. Roy, Canton; Roosevelt Johnson, Detroit; Gregory J. Balazich, Westland, all of Mich.

[73] Assignee: United Technologies Automotive, Inc., Dearborn, Mich.

[21] Appl. No.: 100,155

[22] Filed: Sep. 23, 1987

[51] Int. Cl.[4] ..... H01R 13/64

[52] U.S. Cl. ..... 439/677; 439/723; 439/856

[58] Field of Search ..... 439/709, 712, 713, 715, 439/718, 723–725, 729, 733, 739, 743, 744, 746, 786, 787, 816, 818, 823, 833, 834, 839, 845, 846, 848–850, 852, 856, 857, 871, 872, 677, 679

[56] References Cited

U.S. PATENT DOCUMENTS

| | | | |
|---|---|---|---|
| 2,703,395 | 3/1955 | Long | 339/205 |
| 3,083,345 | 3/1963 | Scheller | 439/677 |
| 3,310,772 | 3/1967 | Kirk et al. | 339/217 |
| 3,713,080 | 1/1973 | Kennedy | 339/258 R |
| 3,718,895 | 2/1973 | Reynolds et al. | 339/258 R |
| 3,787,801 | 1/1974 | Teagno et al. | 339/258 R |
| 4,159,160 | 6/1979 | Plyler et al. | 339/217 S |
| 4,346,959 | 8/1982 | Daugherty et al. | 339/217 |
| 4,390,231 | 6/1983 | Plyer et al. | 439/872 |
| 4,472,017 | 9/1984 | Sian | 339/217 |
| 4,607,907 | 8/1986 | Bogursky | 439/856 |

*Primary Examiner*—David Pirlot

[57] ABSTRACT

An electrical component housing assembly having a main housing body (2) containing a matrix (12) of receptacle cavities (34) being adapted to accommodate mating single receptacles (4) or mating double receptacles (6). The electrical receptacles include polarizing tabs (170, 270) which are received in polarizing slots (40) of the receptacle cavities (34) upon the condition that the receptacles are properly oriented with respect to the receptacle cavities. Locking tabs (172, 272) located on the receptacle (4, 6) respectively engage with the recessed channels (42) and walls (43) to secure the receptacles within the cavities (34). A locking bar (8) interacts with a locking member (37) that engages cutout portion (168, 268) of a receptacle (4, 6) to further secure the receptacles within the cavities. Contact portion (22) of power lead terminal (20) employs a plurality of holes (24) in combination with a fastener for each hole to provide improved electrical contact between the power lead terminal (20) and the bus bar (14).

12 Claims, 7 Drawing Sheets

ELECTRICAL TERMINAL RECEPTACLE AND ELECTRICAL COMPONENT HOUSING ADAPTED FOR THE SAME

CROSS REFERENCE TO RELATED APPLICATIONS

This application relates to commonly assigned copending U.S. patent application Ser. No. 110,160, now U.S. Pat. No. 4,772,759.

TECHNICAL FIELD

The field of art to which this invention pertains is electrical terminal receptacles and accommodating electrical component housings particularly suitable for use with electrical power distribution networks in automobiles and specifically fuse device and relay housings

BACKGROUND ART

Electrical component housings are commonly used in the automotive industry to house fuse devices and relay devices that are necessary to protect or perform various functions in a motor vehicle's electrical power distribution network.

Electrical connections within the housing are accomplished by using electrical terminals designed to be mounted and retained in the housing body. Typically, electrical terminals retained in the housing are called electrical terminal receptacles. The receptacles are electrically conductive and are designed to receive mating terminals. Mating terminals may be attached to a fuse or another electrical element. The electrical terminal receptacle, which is inserted into the housing body, is typically connected to an insulated wire or another mating terminal that is connected to the automobile's electrical power source.

Because the electrical terminal receptacles may be required to mate with mating terminals of varying contact dimensions, it is thus necessary to polarize the receptacles in the cavities of the housing body. In addition to polarizing the receptacles, it is desired that the receptacles be easy to install in the housing body and that they be restrained from undesired removal when the mating terminal is withdrawn from the receptacle. There is also a desire to provide electrical terminal receptacles of enhanced structural strength.

DISCLOSURE OF THE INVENTION

An object of this invention is to provide a means for polarizing the orientation of an electrical terminal receptacle in a mating cavity which is located in an electrical component housing.

Another object of the invention is to provide a receptacle which can accept a plurality of mating electrical terminals.

In another embodiment, the receptacle can be configured to provide a means for making an electrical connection with a wire.

A further object of this invention is to provide a means for polarizing the orientation of electrical terminal receptacles in a receptacle matrix of an electrical component housing assembly in which there are receptacle receiving cavities. The housing assembly is adapted to secure the receptacles and other electrical devices. Additionally, should a person attempt to incorrectly install a receptacle in the receiving cavity of the housing assembly, the polarizing means will prevent damage to the receptacle.

Another object of this invention is to provide a receptacle that can be formed from a single stamping and subsequently shaped in such a manner that enhances the structural strength of the receptacle and may receive a plurality of mating terminals within each receptacle.

A further object of the invention is to provide a receptacle that is self-positioning within the receptacle cavity regardless of the orientation of the receptacle as finally installed thereby facilitating the subsequent installation of mating terminals.

Yet another object of the invention is to provide a power lead terminal that may be used in the electrical component housing assembly; said terminal has a tab with a plurality of holes in which a fastening means may be used to improve the electrical contact characteristics of the terminal over conventional power lead terminals.

The foregoing and other features and advantages of the present invention will become more apparent from the following description, drawings, and appended claims.

BEST MODE FOR CARRYING OUT THE INVENTION

Figure 1:
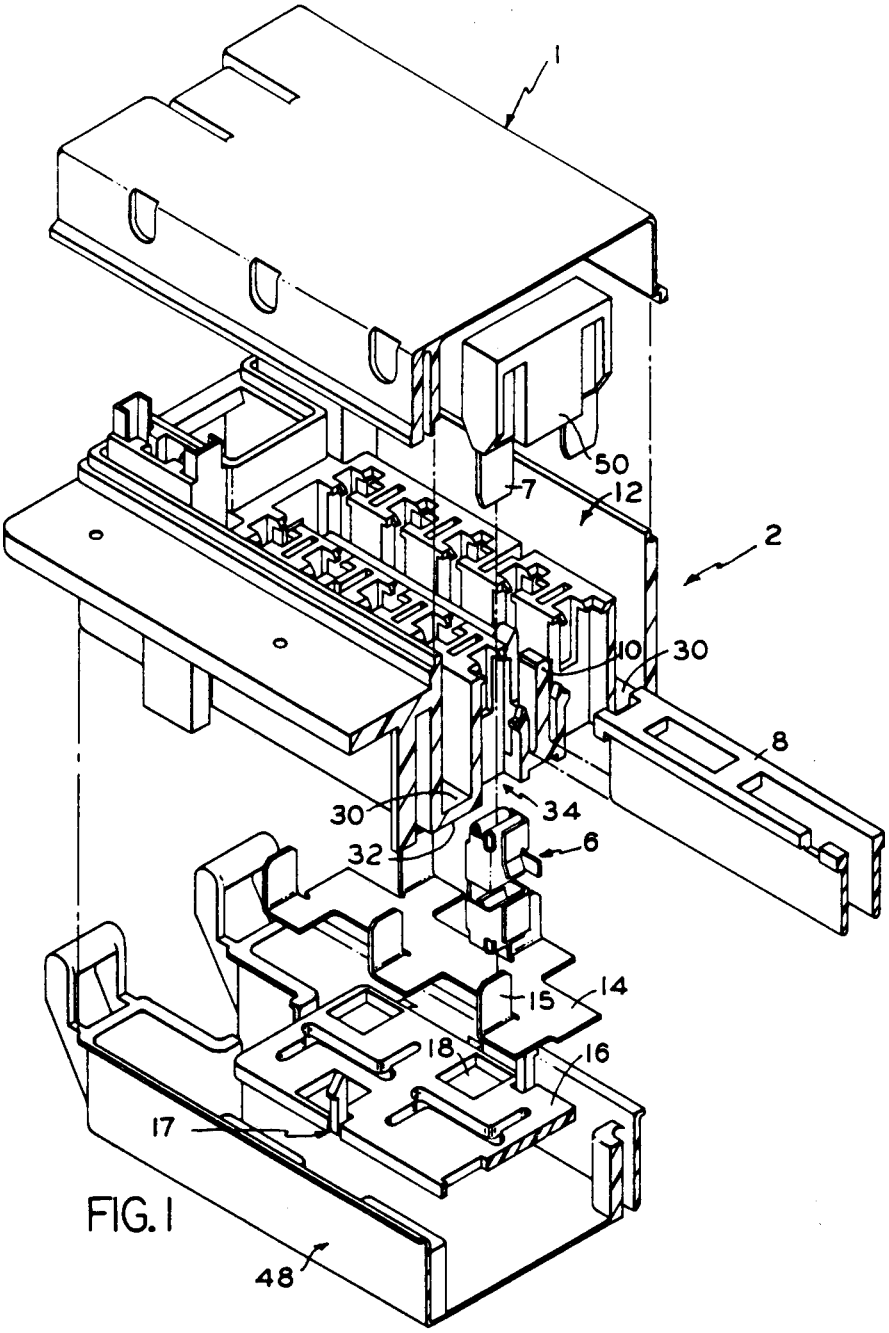
FIG. 1 is an exploded, perspective view of the electrical component housing assembly which is broken away and partially sectioned.
Figure 2:
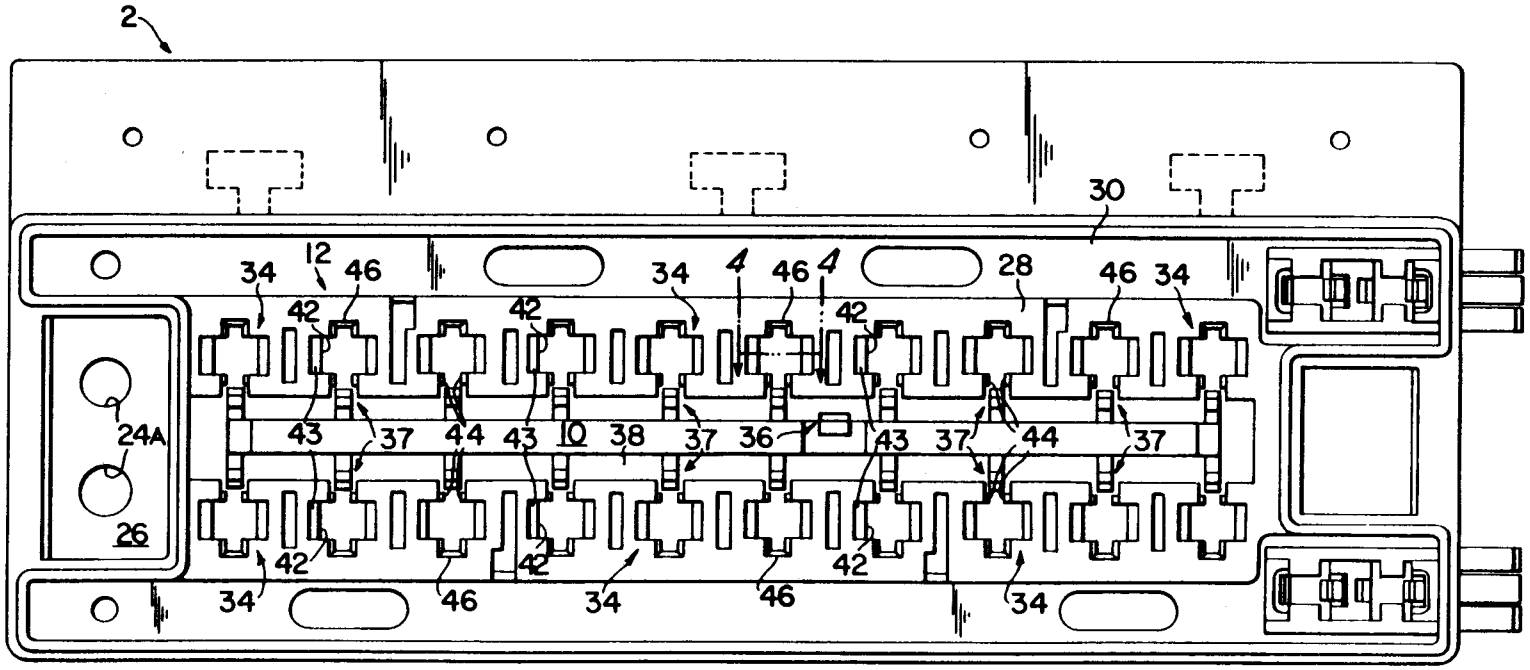
FIG. 2 is a top view of the main body of the electrical component housing assembly.
Figure 3:
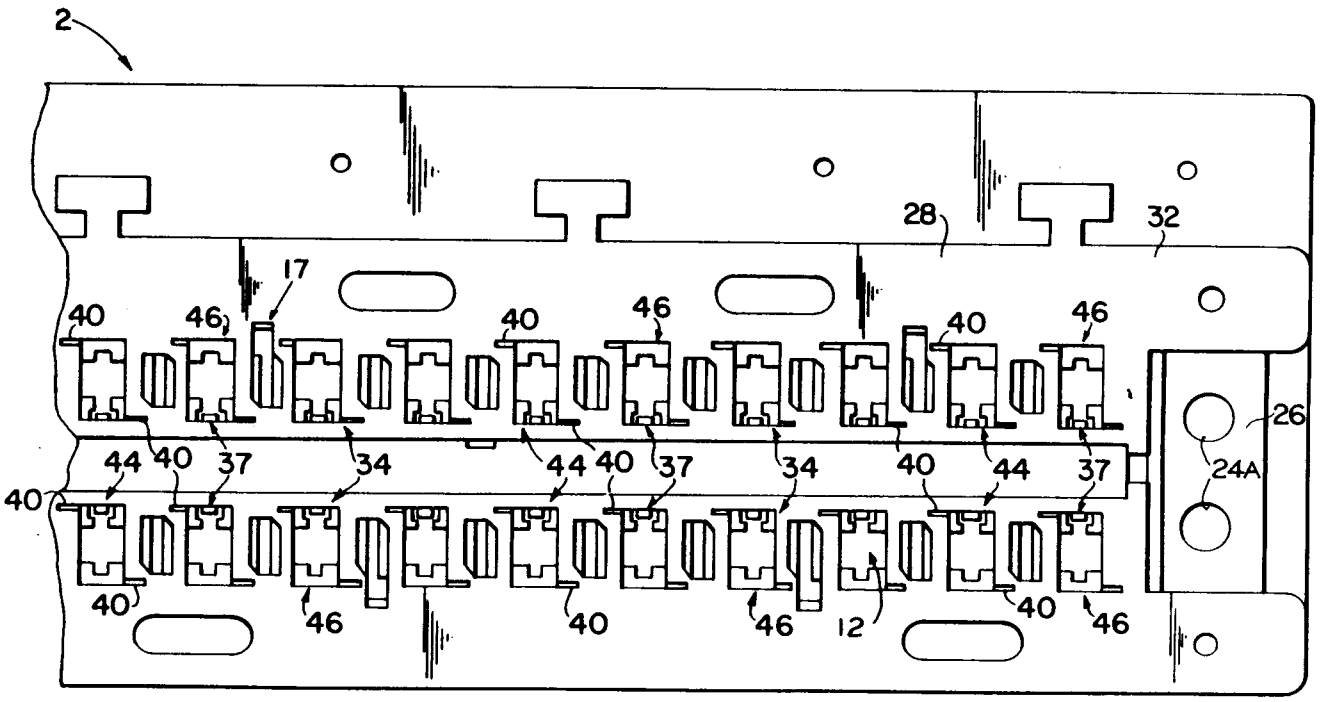
FIG. 3 is a broken-away, bottom view of the main body of the electrical component housing assembly.
Figure 11:
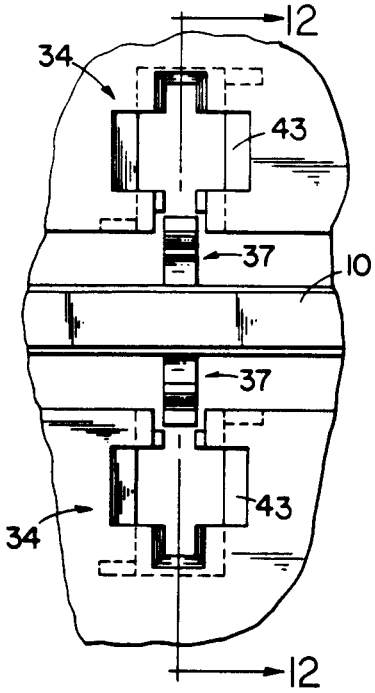
FIG. 11 is a broken away, top view of the receptacle matrix located in the main body of the electrical housing assembly.

Referring now to the drawings, FIG. 1 illustrates an embodiment of the present invention having an electrical component housing assembly molded from a plastic material meeting desired requirements. Main body housing 2, top cover 1, and bottom cover 48 when assembled together, form a rectangular structure. Main body housing 2 is a unitary piece and includes back panel 28 shown in FIG. 2. Back panel 28 includes internal face 30 facing toward top cover 1, and face 30 is recessed from the projecting matrix 12, the external face 32 (shown in FIG. 3) facing toward bottom cover 48. Receptacle cavities 34 are designed to accommodate electrical terminal receptacles as subsequently described herein and are arranged in rows to form receptacle matrix 12 as shown in FIGS. 1–3. Each receptacle cavity 34 is defined by facing guide/retaining tabs 44, notched shelf 46, back panel 28, the walls of recessed channels 42 and the walls defining recessed channels 43. Receptacle cavities 34 include polarizing slots 40 (FIG. 3) which extend from back panel 28 into cavity 34. FIG. 11 shows a top view of the receptacle cavity and the hidden lines represent the profile of polarizing slots 40 located in back panel 28.

Figure 6:
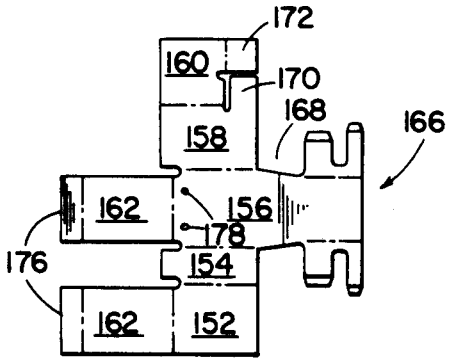
FIG. 6 is a top view of the blank to form a single receptacle.
Figure 7:
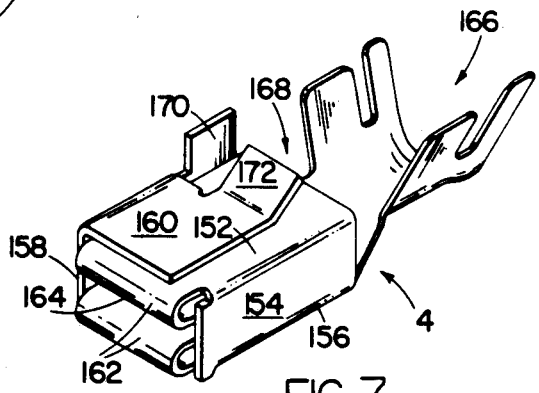
FIG. 7 is a perspective view of the single receptacle.
Figure 10:
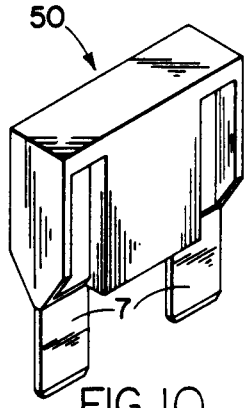
FIG. 10 is a perspective view of a fuse device with blade terminals.
Figure 9:
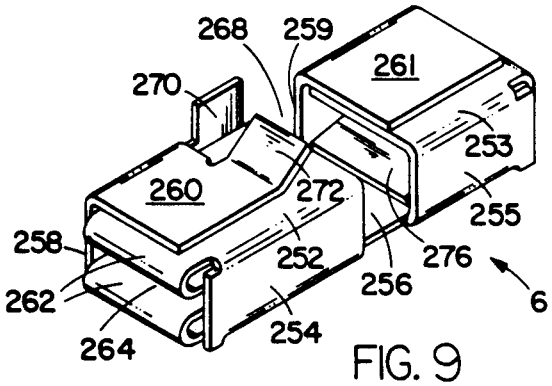
FIG. 9 is a perspective view of the double receptacle.

Two types of electrical terminal receptacles 4 and 6 are described herein and illustrated in FIG. 7 and FIG. 9, respectively. FIG. 7 shows single receptacle 4 which is designed to have an electrical connection end 166 for making an electrical connection to an external member such as an insulated electrical wire and upon the other end, contact area 164 for accommodating a mating terminal such as a terminal 7 attached to fuse 50 as shown in FIG. 10. Single receptacle 4 is formed from a blank metallic sheet, which is flexible enough to have spring-like characteristics yet which is malleable enough to be worked into a structure. FIG. 6 shows the layout of single receptacle 4 as it is stamped from a metallic sheet material by an appropriate manufacturing process. The dotted lines indicate where the stamping is to be folded in order to achieve formed receptacle 4. Single receptacle 4 includes lower panel 156 having outlying integral contact spring member 162, which is adjoined to first side panel 154 which is positioned substantially perpendicular and adjacent to lower panel 156. Opposite to first side panel 154 is second side panel 158 which is bent so as to be positioned substantially perpendicular and adjacent to lower panel 156. First side panel 154 adjoined to interior upper panel 152 has an outlying spring member 162 formed from a portion of interior upper panel 152, said upper panel being folded to be perpendicular to first side panel 154, and thereby being positioned directly opposite lower panel 156 to form a box-shaped end of receptacle 4. Contact spring members 162 of both lower panel 156 and interior upper panel 152 are directed inwardly and end portions 176 are angled outwardly away from the interior of the contact area 164 to abut against lower panel 156 and interior upper panel 152, respectively. By abutting end portions 176 against the panels, a sliding bearing is created which supports contact spring members 162 especially when a mating terminal is being inserted into the receptacle. By supporting contact spring member 162, improved electrical contact is achieved between the mating terminal and contact spring members 162 and the ability of contact spring member 162 to restrain a mating terminal in the contact area 164 is increased.

Exterior upper panel 160 which adjoins second side panel 158 is folded over interior upper panel 152 thereby adding strength to the already box-like structure and simultaneously optimizing electrical contact area 164 of receptacle 4. Incorporated within exterior upper panel 160 are polarizing tab 170 and locking tab 172. Polarizing tab 170 in this embodiment extends upwardly and is in the same plane as second side panel 158. The orientation of the polarizing tab 170 may be modified to suit the particular needs of a given application. Polarizing tab 170 is allowed to pass through corresponding polarizing slots 40 located in back panel 28 of main housing body 2 shown in FIG. 3, providing the receptacle is properly oriented with respect to which end is to be first inserted into a receptacle of receptacle matrix 12 of main housing body 2.

Figure 5:
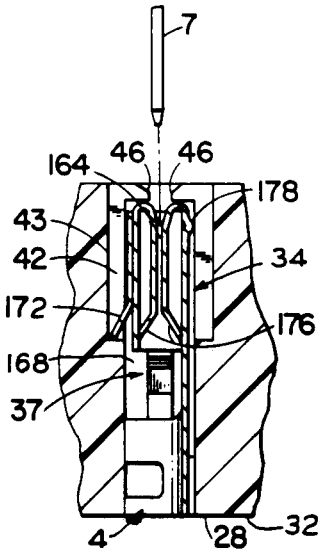
FIG. 5 is a sectional view taken at line 4—4 in FIG. 2 of the receptacle cavity with a single receptacle located therein.

Locking tab 172, shown in FIG. 7, projects outwardly at an angle away from upper interior panel 152 in this embodiment. Locking tab 172 is received by corresponding recess channel 42 of the housing as shown in FIG. 5 upon full insertion of receptacle 4 into the receptacle cavity. When fully inserted, locking tab 172 abuts against the wall defined by channel 43 which keeps receptacle 4 from being pushed out of receptacle cavity 34 when a mating terminal, such as terminal 7, is being inserted into the receptacle.

As with polarizing tab 170, locking tab 172 can be located in one or more exterior panels of receptacle 4.

In this embodiment, dimples 178 project outwardly from lower panel 156 in order to compensate for the thickness of the material of exterior upper panel 160. By compensating for the thickness of the exterior upper panel 160, the receptacle will be nearly concentric when it is located in the receptacle cavity 34 no matter what its final orientation is in the cavity. Cutout 168 is located between means for making electrical connection 166 and contact area 164. Cutout 168 is engaged by cutout engaging means 37 which extends from internal face 30 upwards through receptacle cavity 34.

Figure 4:
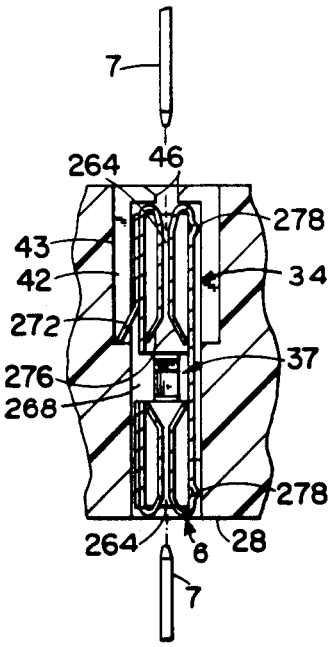
FIG. 4 is a sectional view taken at line 4—4 in FIG. 2 of the receptacle cavity with a double receptacle shown therein.

Facing guide/retaining tabs 44 and notched shelf with inwardly tapering edges 46 located in receptacle matrix 12, help to guide mating terminals such as terminals 7 shown in FIGS. 4 and 5 into receptacle cavity 34 of FIG. 2. Upon removal of the mating terminals, facing guide/retaining tabs 44 and notch shelf 46 also prevent the receptacle from being pulled out of receptacle matrix 12.

Figure 8:
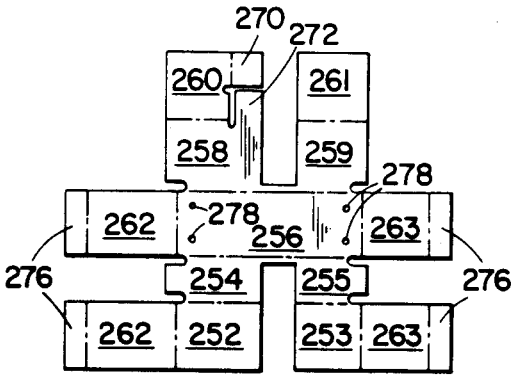
FIG. 8 is a top view of the blank to form a double receptacle.

Double receptacle 6 shown in FIG. 9 is formed in the same manner and has many common features as single receptacle 4 as shown in FIG. 7. As with single receptacle 4, double receptacle 6 is shaped from a metallic stamping but having the configuration as shown in FIG. 8. Double receptacle 6 differs from single receptacle 4 by being able to accommodate additional mating terminals due to having additional contact area 264 (not shown) and separated by cutout portion 268 not shown. By having a plurality of contact areas 264, double receptacle 6 does not have the type of means for making electrical connections 166 as does single receptacle 4 shown in FIG. 7. Returning to FIG. 8, double receptacle 6 has additional dimples 278 to compensate for the thickness of additional exterior upper panel 260. An additional polarizing tab 270 and/or locking tab 272 may be located in any panel which defines the additional contact area 264 of double receptacle 6.

Receptacle cavity 34 as shown in FIGS. 4 and 5 can accommodate either double receptacle 6 (FIG. 4) or single receptacle 4 (FIG. 5), without modifying receptacle cavity 34. Cutout portion 268 of double receptacle 6 or cutout portion 168 of single receptacle 4 is engaged by cutout engaging means 37 which is accommodated by adjoining step 38 and receptacle matrix 12. FIG. 4 illustrates that a mating terminal may be inserted through the back panel 28 of main housing body 2 to double receptacle 6 which has been either previously installed or simultaneously installed in receptacle cavity 34. Receptacle matrix 12 can accommodate any combination of: single receptacle 4, double receptacle 6, or no receptacles at all.

Figure 12:
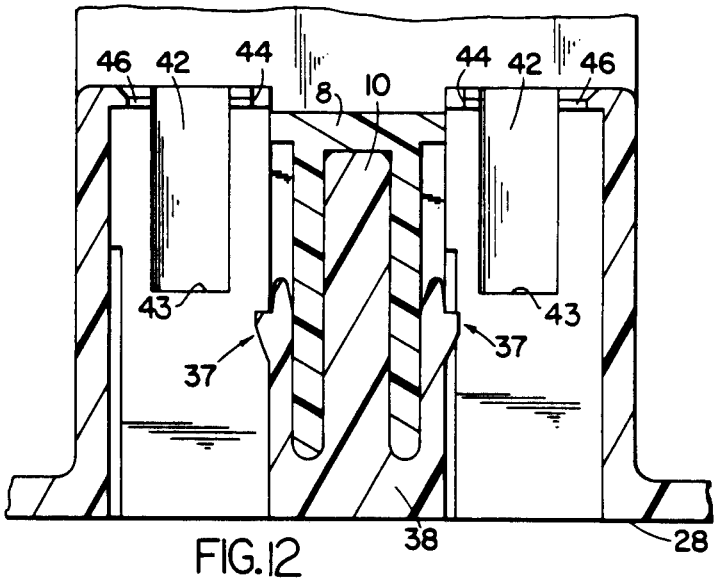
FIG. 12 is a cross-sectional end view of the receptacle matrix located in the main body housing of the electrical terminal housing assembly.

In order to increase the stability of the receptacle while in service, locking bar 8 shown in FIG. 1 and FIG. 12 is positioned in receptacle matrix 12 between rows of receptacle cavities 34. Locking bar 8 engages cutout engaging means 37 shown in FIG. 12 and displaces said means outwardly upon assembly to ensure that cutout portion 168 or 268 (not shown) of a receptacle is adequately engaged by the cutout engaging means to lock the receptacles in position. Locking bar 8 is positioned in receptacle matrix 12 by locking bar positioner 10 which also has means for fastening 36 (shown in FIG. 2) for securing locking bar 8 to locking bar positioner 10.

Figure 13:
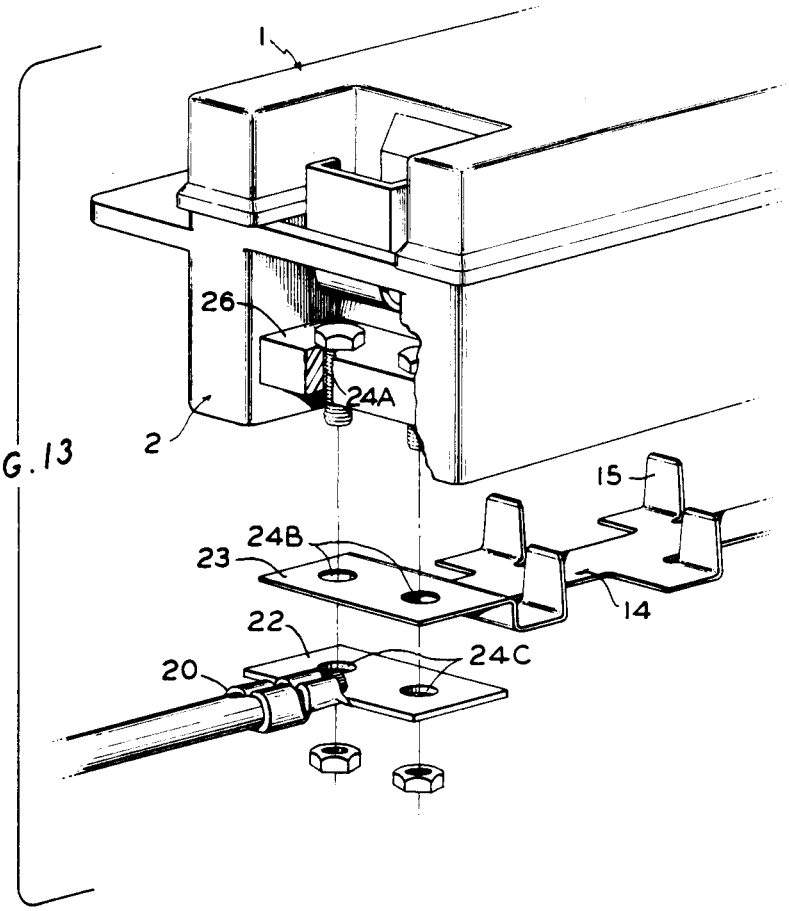
FIG. 13 is a perspective view of the bus bar, power lead terminal, and a portion of the electrical component housing assembly which is partially sectioned and partially broken away. The assembly shown is the opposite end of the assembly in FIG. 1.

Bus bar 14 as may be seen in FIGS. 1 and 13 is fabricated from an electrical conducting material which is shaped to provide an electrical current path from power lead terminal 20 to preselected receptacle cavities 34. In this embodiment, bus bar 14 uses mating terminals 15 to complete the path to double receptacles 6 located in preselected receptacle cavities 34.

Bus bar 14 is protected from undesired electrical shorts by bus bar insulator 16. Bus bar insulator 16 as shown in FIG. 1 includes openings which are aligned with preselected cavities 34 for gaining access to those cavities so that receptacles, wires, or other components can pass through bus bar insulator 16. Should receptacle cavities 34 be vacant, air will be able to flow more freely through receptacle matrix 12 and through the openings located in bus bar insulator 16.

A plurality of holes labeled as 24A are located in flange 26 of main housing body 2, 24B located in bus bar flange 23, and 24C located in contact portion 22 of power lead terminal 20. A fastening means such as bolts extending through multiple sets of holes provides a superior electrical contact between bus bar 14 and contact portion 22 of power lead terminal 20 in comparison to using only one fastening means with one set of holes to join the power lead terminal to the bus bar.

Although the invention has been shown and described with respect to detailed embodiments thereof, it will be understood by those skilled in the art that various changes in the form and detail thereof may be made without departing from the spirit and scope of the invention.

What is claimed is:

1. A unitary electrical terminal receptacle constructed to receive a mating terminal and to be secured within a mating terminal housing constructed to receive said receptacle and a bus bar, comprising:

(a) a multi-panel, open-ended generally rectangular receptacle having an interior upper panel being adjacent to a first side panel, a lower panel being adjacent to the first side panel and opposing the interior upper panel, a second side panel being adjacent to the lower panel and opposing the first side panel, and an exterior upper panel being adjacent to the second side panel and overlapping the interior upper panel;

(b) the lower panel and the interior upper panel each having contact spring members which extend inwardly into the receptacle so as to form a contact area of the receptacle providing means for contacting and restraining the mating terminal;

(c) at least one of said panels having means connected thereto for making electrical connections and with a cutout located between the contact area and the means for making electrical connections;

(d) a polarizing tab projecting outwardly from at least one of said panels to insure that the contact area of the receptacle is oriented correctly in a receiving cavity located in the mating housing adapted to receive said receptacle and defining a visible polarizing slot adapted to receive the polarizing tab;

(e) a resilient locking tab extending outwardly at an angle away from at least one of said panels, whereby the resilient locking tab may engage a wall defining a complementary recessed channel of said housing; and (f) a bus bar shaped to provide an electrical current path to said receptacles located in preselected cavities and a power lead terminal connected to the bus bar.

2. A unitary electrical terminal receptacle as set forth in claim 1 which further comprises the exterior upper panel overlapping and sufficiently engaging the interior upper panel so as to provide means for increasing the overall strength of the receptacle.

3. A unitary electrical terminal receptacle as set forth in claim 1 in which at least one of the panels has a plurality of outwardly projecting dimples in order to compensate for the thickness of an oppositely positioned exterior panel thereby enhancing the future installation of the mating terminal by allowing the receptacle to be concentric within the receiving cavity of said housing regardless of the orientation of the terminal as finally installed in the receiving cavity.

4. A unitary electrical terminal receptacle as set forth in claim 1 in which the contact spring members further comprise end portions that abut against a respectively adjacent panel of each contact spring member and which provides sliding support to the contact spring member thereby enhancing the contacting and restraining of mating terminals in the contact areas.

5. A unitary electrical terminal receptacle as set forth in claim 4 in which the contact spring members further comprise end portions that abut against a respectively adjacent panel of each contact spring member and which provides sliding support to the contact spring member thereby enhancing the contacting and restraining of mating terminals in the contact areas.

6. A unitary electrical terminal receptacle constructed to receive a plurality of mating terminals and to be secured within a mating terminal housing constructed to receive said receptacle and a bus bar, comprising, (a) a multi-paneled, open-ended generally rectangular receptacle having an interior upper panel being adjacent to a first side panel, a lower panel being adjacent to the first side panel and opposing the interior upper panel, a second side panel being adjacent to the lower panel and opposing the first side panel, and an exterior upper panel being adjacent to the second side panel and overlapping the interior upper panel;

(b) a cutout located longitudinally along the panels so as to divide the panels into at least two contact areas, each contact area appropriately dimensioned to provide means for contacting and restraining a mating terminal having complementary dimensions;

(c) the lower panel and the interior upper panel each having contact spring members which extend inwardly into the receptacle so as to form a multiplicity of contact areas of the receptacle that provides means for contacting a restraining the mating terminals;

(d) polarizing tab projecting outwardly from at least one of said panels to insure that the contact areas of the receptacle are oriented correctly in a receiving cavity located in the housing adapted to receive said receptacle and defining a visible polarizing slot adapted to receive the polarizing tab;

(e) a resilient locking tab, extending outwardly at an angle away from at least one of said panels, whereby the resilient locking tab may be engaged to a wall defined by a complementary recessed channel of said housing; and (f) a bus bar shaped to provide an electrical current path to said receptacles located in preselected cavities and a power lead terminal connected to the bus bar.

7. A unitary electrical terminal receptacle as set forth in claim 6 which further comprises the exterior upper panel overlapping and sufficiently engaging the interior upper panel so as to provide means for increasing the overall strength of the receptacle.

8. A unitary electrical terminal receptacle as set forth in claim 6 in which at least one of the panels has a plurality of outwardly projecting dimples in order to compensate for the thickness of an oppositely positioned exterior panel thereby enhancing the future installation of the mating terminals by allowing the receptacle to be properly aligned with the receiving cavity of said housing regardless of the orientation of the terminal as finally installed in the receiving cavity.

9. An electrical component housing assembly adapted to receive and secure at least one electrical terminal receptacle wherein the electrical terminal receptacle includes a cutout portion, a locking tab and a polarizing tab comprising:

(a) a main body having a bottom panel with internal and external faces and a receptacle receiving matrix projecting from the internal face of the bottom panel;

(b) said receptacle matrix including a multiplicity of individual receptacle receiving cavities being arranged in rows and columns, the cavities being generally rectangular and configured to receive the receptacles without allowing the receptacles to pass entirely through the matrix;

(c) a bus bar shaped to provide an electrical current path to receptacles located in preselected cavities and a power lead terminal connected to the bus bar;

(d) a locking bar positioner located between receptacle cavities and a mating locking bar secured to the locking bar positioner and shaped to interact with said means for engaging the cutout incorporated in the receptacle;

(e) each cavity including an adjoining step for accommodating means for engaging the cutout portion of the receptacle in order to lock the receptacle in the cavity;

(f) each cavity further including at least one recessed channel fashioned to accommodate and engage the resilient locking tab of the receptacle; and (g) each cavity further including at least one polarizing slot to accommodate the polarizing tab of the receptacle.

10. An electrical component housing assembly as set forth in claim 9 further comprising the cavity having a notched shelf with inwardly tapered edges and an oppositely positioned set of facing integral guide/retaining tabs, wherein the notched shelf and the guide/retaining tabs in combination allow and facilitate the insertion of a mating terminal into the receptacle, yet retain the receptacle in the cavity if the mating terminal is extracted from the receptacle.

11. An electrical component housing assembly as set forth in claim 9 and further comprising:

a bus bar insulator having a multitude of openings, the openings being positioned to align with the cavities located in the matrix whereby receptacles or other components may be inserted into a portion of the cavities and air is allowed to flow through the cavities that are vacant.

12. An electrical component housing assembly as set forth in claim 9 further comprising:

a plurality of mounting holes located in a contact portion of the power lead terminal which in conjunction with a fastening means for each mounting hole enhances the electrical connection between the contact portion of the power lead terminal and the bus bar.

* * * * *